United States Patent [19]

Gebhardt et al.

[11] Patent Number: 4,589,349

[45] Date of Patent: May 20, 1986

[54] EXTENDIBLE SHELF

[75] Inventors: James L. Gebhardt, Roswell; James Hanna, Athens; Douglas Whiten, Marietta, all of Ga.

[73] Assignee: The Mead Corporation, Dayton, Ohio

[21] Appl. No.: 378,069

[22] Filed: May 14, 1982

[51] Int. Cl.[4] ..... A47B 11/00

[52] U.S. Cl. ..... 108/102; 108/27; 108/62; 108/137; 211/132; 211/181; 248/429

[58] Field of Search ..... 108/62, 63, 27, 13, 108/102, 137, 143; 211/181, 150, 162, 184, 151, 132; 248/429; 312/334, 335, 338

[56] References Cited

U.S. PATENT DOCUMENTS

| | | | |
|---|---|---|---|
| 953,857 | 4/1910 | Reynolds | 248/241 |
| 1,702,937 | 2/1929 | Friedemann | 248/243 |
| 1,769,190 | 7/1930 | Rush | 211/132 |
| 2,168,172 | 8/1939 | Rees | 108/62 |
| 2,251,638 | 8/1941 | Sanford | 248/241 |
| 2,266,206 | 12/1941 | Jackson et al. | 248/243 |
| 2,287,611 | 6/1942 | Harbison | 108/62 |
| 2,319,470 | 5/1943 | Nobles | 211/153 |
| 2,509,546 | 5/1950 | Welk et al. | 108/62 X |
| 2,517,284 | 8/1950 | Calvert | 211/153 |
| 2,542,872 | 2/1951 | Kanter et al. | 248/241 |
| 2,717,816 | 9/1955 | Turner | 108/143 X |
| 2,980,483 | 4/1961 | Davis | 312/297 X |
| 3,027,016 | 3/1962 | Becht | 211/153 |
| 3,164,353 | 1/1965 | Rene | 248/241 X |
| 3,242,885 | 3/1966 | Baker et al. | 108/137 X |
| 3,305,102 | 2/1967 | Saphirstein | 211/184 |
| 3,388,808 | 6/1968 | Radek | 211/132 |
| 3,612,288 | 10/1971 | Lesley | 211/132 |
| 3,794,183 | 2/1974 | Colbridge | 248/243 |

FOREIGN PATENT DOCUMENTS

| | | | |
|---|---|---|---|
| 592507 | 2/1960 | Canada | 248/243 |
| 378025 | 6/1907 | France | 248/241 |
| 51314 | 2/1919 | Sweden | 211/153 |
| 225103 | 11/1924 | United Kingdom | 248/243 |
| 414757 | 10/1934 | United Kingdom | 248/241 |

*Primary Examiner*—James T. McCall

*Attorney, Agent, or Firm*—Rodgers & Rodgers

[57] ABSTRACT

For use as a component of a display stand, an extendible shelf comprises a pair of elongated primary bracket elements each arranged for mounting at one end thereof on suitable supporting means such as a pair of upright elements forming components of a display stand, a pair of secondary bracket elements telescopically mounted respectively on said primary bracket elements, a main shelf element supported at its ends by the secondary bracket elements, and a collapsible shelf element including at least two hingedly connected parts one of which is hingedly connected with the rear of said main shelf element and the other of which is hingedly connected with said primary elements respectively, said collapsible shelf element being in collapsed condition when said main shelf element is in its retracted position and being effective to form a supplementary shelf at the rear of said main shelf element when said main shelf element and said secondary bracket elements are in their extended positions.

9 Claims, 2 Drawing Figures

EXTENDIBLE SHELF

TECHNICAL FIELD

This invention relates to display stands such as are used primarily in supermarket outlets for displaying point of purchase items such as soft drinks and the like.

BACKGROUND ART

U.S. Pat. No. 3,993,002 issued Nov. 23, 1976 discloses a shelf arrangement in which uprights are arranged so as to support a pair of brackets to which a shelf structure is secured. This patent does not disclose an extendible shelf.

U.S. Pat. No. 3,403,789 issued Oct. 1, 1968 discloses a hingedly mounted shelf arrangement in which a pair of shelf elements are arranged so that one element may be extended outwardly thereby to increase the shelf area.

U.S. Pat. No. 3,612,288 issued Oct. 12, 1971 discloses a plurality of hingedly connected panels interposed between layers of packaged items so as to impart stability to the overall stack of items.

None of the above patents discloses a pair of primary brackets which respectively are cooperatively associated with a pair of secondary bracket elements and arranged to form an extendible structure which is adaptable for use as a single display unit or which may be employed as a component of a single display stand or of an end or intermediate stand constituting one of a series of display stands arranged in side by side relationship.

DISCLOSURE OF THE INVENTION

According to this invention in one form, an extendible shelf for a display stand is provided and comprises a pair of elongated primary bracket elements each arranged for mounting at one end thereof on supporting means such as an upright of a display stand, a pair of secondary bracket elements telescopically mounted respectively on said primary bracket elements, a main shelf element supported by said secondary bracket elements and arranged with its ends secured respectively to said secondary bracket elements, and a collapsible shelf element having at least two hingedly connected parts one of which is hingedly connected with the rear of said main shelf element and the other which is hingedly connected with said primary bracket elements respectively, said collapsible shelf elements being in collapsed condition when said main shelf element is in its retracted position and being effective to form a supplementary shelf at the rear of said main shelf element when said main shelf element and said secondary bracket elements are in their extended positions.

BRIEF DESCRIPTION OF THE DRAWINGS

In the drawings,

FIG. 1 is a perspective view of a pair of display stands arranged in side by side relation and which incorporate extendible shelves formed according to this invention and in which

BEST MODE OF CARRYING OUT THE INVENTION

Figure 1:
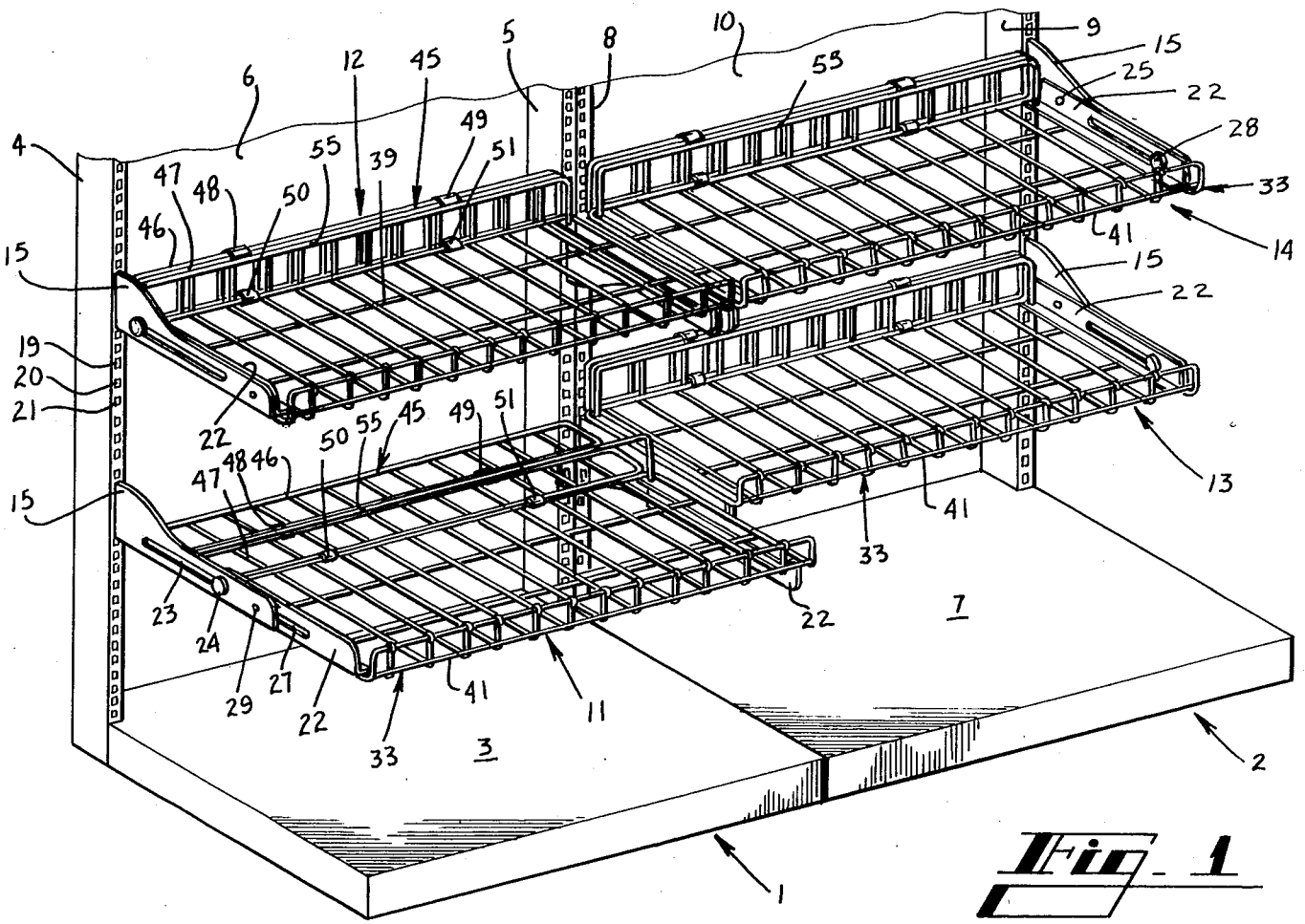

In FIG. 1 a pair of display stands are generally indicated by the numerals 1 and 2 and are disposed in side by side relation. Display stand 1 comprises a base 3 of conventional construction to the rear edge of which a pair of upright elements 4 and 5 are secured. A back panel 6 is secured along its side edges to the rear portions of the uprights 4 and 5.

Similarly display stand 2 comprises a base element 7 to the rear portion of which a pair of uprights 8 and 9 are secured. A back panel 10 is secured along its side edges to the rear surfaces of uprights 8 and 9.

Supported by uprights 4 and 5 are a pair of extendible shelves generally indicated by the numerals 11 and 12 while extendible shelves 13 and 14 are mounted on and supported by uprights 8 and 9. Extendable shelves 12–14 are formed of identical components although the arrangement of parts is such that the primary and secondary bracket elements which form parts of all of the extendible shelves and which are located immediately adjacent each other at the uprights 5 and 8 are inverted from the corresponding parts associated with uprights 4 and 9 respectively in accordance with one feature of this invention.

Since all of the extendible shelves 11–14 include identical parts, only one such extendible shelf such as 11 is here described in detail.

Figure 2:
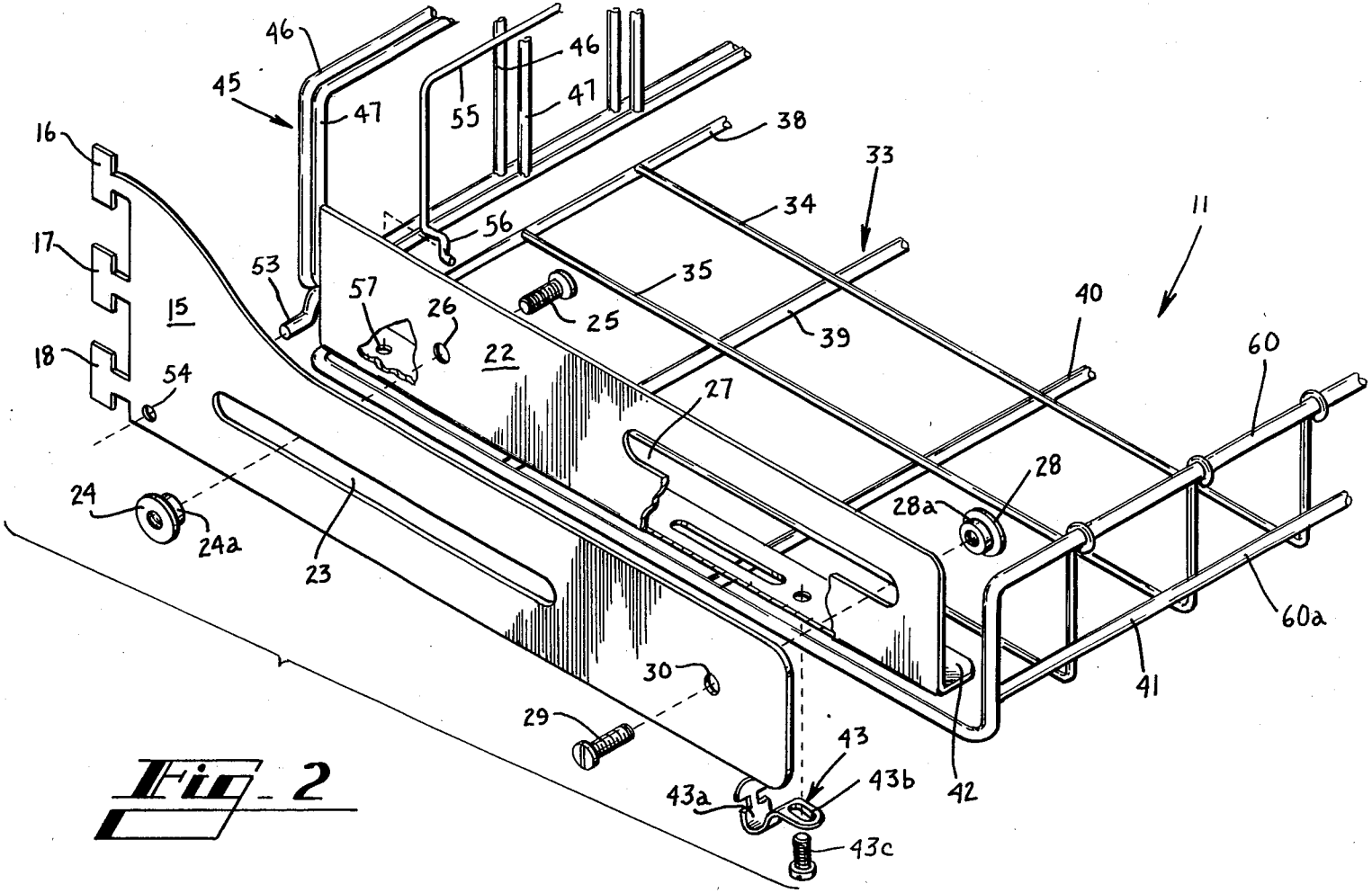
FIG. 2 is an enlarged exploded view of one end of an extendible shelf formed according to this invention.

With reference to FIG. 2 the numeral 15 designates a primary bracket element to the left hand end of which a plurality of generally T-shaped fastening elements 16, 17 and 18 are integrally formed. These fastening elements 16–18 are arranged for insertion into appropriate apertures such as are indicated by the numerals 19, 20 and 21 in FIG. 1. A secondary bracket element 22 is telescopically mounted on primary bracket element 15. A slot 23 is formed in primary bracket element 15 and an internally threaded securing means 24 is arranged so that its reduced diameter portion 24*a* rides in the slot 23 and a bolt 25 is inserted through aperture 26 formed in secondary bracket element 22 so that threaded engagement of bolt 25 into the internally threaded securing means 24 secures the secondary bracket element 22 in close side by side relation with the primary bracket element 15. Similarly a slot 27 is formed in secondary bracket 22 and a securing means 28 having a reduced diameter portion 28*a* is arranged to be inserted into the slot 27. Securing means 28 is held in position by means of a bolt 29 which is mounted in aperture 30 formed in primary bracket 15, bolt 29 being threaded into the internally threaded securing means 28. By this means secondary bracket element 22 is telescopically related with primary bracket 15. When secondary bracket element 22 is moved to a desired position it is secured in this position by simply tightening the bolts 25 and 29 so as to hold primary bracket 15 into snug frictional contact with secondary bracket 22.

As is obvious, the secondary bracket element 22 may occupy a retracted position as represented in connection with extendible shelf 12 or secondary bracket element 22 may occupy an extended position as represented in conjunction with the extendible shelf 11.

Main shelf element is generally indicated in the drawings by the numeral 33 and includes parallel wires such as are indicated at 34, 35, 36 and 37 as well as transverse wires 38, 39, 40 and 41. These wires are suitably interconnected in well known manner so as to form a main shelf element which is secured to the horizontal panel 42 secured to an edge of secondary bracket 22. This securing means may comprise a bracket 43 having a curved portion 43*a* together with a bolt 43*c* arranged for insertion through the aperture 43*b* and the aperture 46 formed in horizontal panel 42. The curved portion 43*a* of bracket 43 simply envelops one of the wires such as 40. Similarly other brackets such as 43 may be used as desired. Of course the opposite edge of the main shelf element 33 as shown in FIG. 2 is broken away but the securement of main shelf element 33 to secondary bracket element 22 which is associated with upright 5 is similar except that the primary bracket element 15 as well as the secondary bracket element 22 are inverted. This invention causes the primary bracket element 15 and secondary bracket element 22 to project downwardly as is shown in FIG. 1 thus affording a continuous supporting surface across the junction between extendable shelf 12 and extendable shelf 10, it being obvious that the primary and secondary bracket elements associated with upright 8 are also inverted. When inverted the main shelf element rests atop the horizontal panel 42 which is then located along the upper edge of secondary bracket 22 whereas when disposed in the positions represented in conjunction with the upright 4, the horizontal panel 42 is disposed along the lower edge of secondary bracket 22.

In order to provide an upstanding support structure for the ends of the shelves 13 and 14, the primary bracket elements 15 are simply mounted on the upright 9 in the same manner that these elements are mounted on upright 4 and the secondary bracket elements 22 are turned end to end so as to cause their horizontal panels 42 to extend inwardly as shown in FIG. 1. The telescoping arrangement is similar to that already described as is obvious.

When a shelf is extended as is represented in connection with shelf 11 in FIG. 1, it is necessary to fill in the space disposed immediately behind the rear edge of the shelf such as main shelf element 33. Toward this end, a collapsible shelf element is provided and is generally designated by the numeral 45. Collapsible shelf element 45 includes a pair of hingedly connected parts 46 and 47, the hinged connection being indicated at 48 and 49. Part 47 is hingedly connected at 50 and 51 with the rear edge 51 of main shelf element 33 while part 46 is hingedly connected by the part 53 which is inserted into aperture 54 formed in primary bracket 15. Thus as the main shelf element 33 and the associated secondary brackets 22 are drawn forwardly to the position represented for example at shelf 11 in FIG. 1, the parts 46 and 47 of collapsible shelf element 45 move into the horizontal position as shown in conjunction with shelf 11.

For the purpose of causing any displayed items mounted atop the main shelf element 33 to move forwardly with the shelf as it is moved outwardly to the position indicated in conjunction with shelf 11, a horizontal pusher bar 55 is provided and is mounted by simply inserting the lower bent end 56 thereof into aperture 57 formed in one end of horizontal panel 42. A similar vertical post such as 56 (not shown) is formed at the other end of horizontal bar 55 and is inserted into an aperture such as 57 formed in the horizontal panel disposed at the right hand edge of the shelf and which is associated with the upright 5.

In order to prevent displayed items from toppling forwardly, a front bumper 60, 60*a* is provided as is obvious from FIG. 2.

INDUSTRIAL APPLICABILITY

An extendable shelf formed according to this invention provides a shelf of variable and determinable depth from front to rear and includes primary and secondary bracket elements which may provide side guards for a free standing display stand or which may be inverted to form a continuous support surface when two or more display stands are mounted alongside each other. The invention significantly maximizes the use of space and significantly increases flexibility in displaying consumer items at the point of purchase.

We claim:

1. An extendible shelf comprising a pair of elongated primary bracket elements each arranged for mounting at one end thereof on supporting means, a pair of secondary bracket elements telescopically mounted respectively on said primary bracket elements, each of said secondary bracket elements comprising a main panel which is vertically disposed and a horizontal panel integral with one edge of said main panel to form a structure which is L-shaped in cross section, said main panel being arranged to cooperate with the associated primary bracket element to provide a telescoping relationship therebetween, a main shelf element supported by and movable with said secondary bracket elements and arranged with its ends secured respectively to said horizontal panels of said secondary bracket elements, a collapsible shelf element having at least two hingedly connected parts one of which is hingedly connected with the rear of said main shelf element and the other of which is hingedly connected with said primary bracket elements respectively, said collapsible shelf element being in collapsed condition when said main shelf element is in its retracted position and being effective to form a supplementary shelf at the rear of said main shelf element when said main shelf element and said secondary bracket elements are in their extended positions, said main shelf element being disposed in substantially the same plane when in its retracted and extended positions and during movement between these positions, and securing means arranged to hold said primary and said secondary bracket elements against telescopic movement so as to hold said collapsible shelf element in a collapsed or horizontal position.

2. An extendible shelf according to claim 1 wherein said supporting means comprises a pair of uprights to which said primary bracket elements are disjointably secured at one end thereof.

3. An extendible shelf according to claim 1 wherein the ends of said main shelf element are secured to said horizontal panel.

4. An extendible shelf according to claim 3 wherein the ends of said main shelf element are secured to the upper surface of said horizontal panel.

5. An extendible shelf comprising a pair of elongated primary bracket elements each arranged for mounting at one end thereof on supporting means, a pair of secondary bracket elements telescopically mounted respectively on said primary bracket elements, said primary and said secondary bracket elements being separately and individually invertible, a main shelf element supported by and movable with said secondary bracket elements and arranged with its ends secured respectively to said secondary bracket elements, a collapsible shelf element having at least two hingedly connected parts one of which is hingedly connected with the rear of said main shelf element and the other of which is hingedly connected with said primary bracket elements respectively, said collapsible shelf element being in collapsed condition when said main shelf element is in its retracted position and being effective to form a supplementary shelf at the rear of said main shelf element when said main shelf element and said secondary bracket elements are in their extended positions, said main shelf element being disposed in substantially the same plane when in its retracted and extended positions and during movement between these positions, and securing means arranged to hold said primary and said secondary bracket elements against telescopic movement so as to hold said collapsible shelf element in a collapsed or horizontal position.

6. An extendible shelf comprising a pair of elongated primary bracket elements each arranged for mounting at one end thereof on supporting means, a pair of secondary bracket elements telescopically mounted respectively on said primary bracket elements, each of said secondary bracket elements comprising a main panel which is vertically disposed and a horizontal panel integral with one edge of said main panel to form a structure which is L-shaped in cross section, said main panel being arranged to cooperate with the associated primary bracket element to provide a telescoping relationship therebetween, said primary and said secondary bracket elements being invertible and wherein said horizontal panel on at least one of said secondary bracket elements is integral with the upper edge of the associated vertical panel, a main shelf element supported by and movable with said secondary bracket elements and arranged with its ends secured respectively to said secondary bracket elements, a collapsible shelf element having at least two hingedly connected parts one of which is hingedly connected with the rear of said main shelf element and the other of which is hingedly connected with said primary bracket elements respectively, said collapsible shelf element being in collapsed condition when said main shelf element is in its retracted position and being effective to form a supplementary shelf at the rear of said main shelf element when said main shelf element and said secondary bracket elements are in their extended positions, said main shelf element being disposed in substantially the same plane when in its retracted and extended positions and during movement between these positions, and securing means arranged to hold said primary and said secondary bracket elements against telescopic movement so as to hold said collapsible shelf element in a collapsed or horizontal position.

7. An extendible shelf comprising a pair of elongated primary bracket elements each arranged for mounting at one end thereof on supporting means, a pair of secondary bracket elements telescopically mounted respectively on said primary bracket elements, each of said secondary bracket elements comprising a main panel which is vertically disposed and a horizontal panel integral with one edge of said main panel to form a structure which is L-shaped in cross section, said main panel being arranged to cooperate with the associated primary bracket element to provide a telescoping relationship therebetween, said primary and said secondary bracket elements being invertible and said horizontal panel on at least one of said secondary bracket elements being integral with the lower edge of the associated vertical panel, a main shelf element supported by and movable with said secondary bracket elements and arranged with its ends secured respectively to said secondary bracket elements, a collapsible shelf element having at least two hingedly connected parts one of which is hingedly connected with the rear of said main shelf element and the other of which is hingedly connected with said primary bracket elements respectively, said collapsible shelf element being in collapsed condition when said main shelf element is in its retracted position and being effective to form a supplementary shelf at the rear of said main shelf element when said main shelf element and said secondary bracket elements are in their extended positions, said main shelf element being disosed in substantially the same plane when in its retracted and extended positions and during movement between these positions, and securing means arranged to hold said primary and said secondary bracket elements against telescopic movement so as to hold said collapsible shelf element in a collapsed or horizontal position.

8. An extendible shelf comprising a pair of elongated primary bracket elements each arranged for mounting at one end thereof on supporting means, a pair of secondary bracket elements telescopically mounted respectively on said primary bracket elements, a main shelf element supported by and movable with said secondary bracket elements and arranged with its ends secured respectively to said secondary bracket elements, a collapsible shelf element having at least two hingedly connected parts one of which is hingedly connected with the rear of said main shelf element and the other of which is hingedly connected with said primary bracket elements respectively, said collapsible shelf element being in collapsed condition when said main shelf element is in its retracted position and being effective to form a supplementary shelf at the rear of said main shelf element when said main shelf element and said secondary bracket elements are in their extended positions, said main shelf element being disposed in substantially the same plane when in its retracted and extended positions and during movement between these positions, securing means arranged to hold said primary and said secondary bracket elements against telescopic movement so as to hold said collapsible shelf element in a collapsed or horizontal position, and a horizontal pusher bar disjointably mounted to and normally movable with said secondary bracket elements and disposed in spaced relation thereabove.

9. An extendible shelf according to claim 8 wherein said pusher bar is supported at its ends by a pair of vertical posts disjointably mounted to said secondary bracket elements adjacent the rear ends thereof respectively.

* * * * *